US010426287B1

(12) United States Patent
Tsai

(10) Patent No.: US 10,426,287 B1
(45) Date of Patent: Oct. 1, 2019

(54) CURTAIN ROD

(71) Applicant: ABO WINDOW FASHION CORP, Chino, CA (US)

(72) Inventor: Meng-Chieh Tsai, Chino, CA (US)

(73) Assignee: ABO WINDOW FASHION CORP., Chino, CA (US)

( * ) Notice: Subject to any disclaimer, the term of this patent is extended or adjusted under 35 U.S.C. 154(b) by 0 days.

(21) Appl. No.: 15/821,755

(22) Filed: Nov. 22, 2017

(51) Int. Cl.
*A47H 1/022* (2006.01)
*A47H 1/02* (2006.01)

(52) U.S. Cl.
CPC ..... *A47H 1/022* (2013.01); *A47H 2001/0215* (2013.01)

(58) Field of Classification Search
CPC ..... A47H 1/022; A47H 2001/0215
USPC ..... 248/354.1, 354.3; 211/123, 105.1, 105.3, 211/105.4, 105.5, 105.6
See application file for complete search history.

(56) References Cited

U.S. PATENT DOCUMENTS 2,298,380 A * 10/1942 Hood ..... F16B 7/14 248/188.5
2,494,878 A * 1/1950 Jensen ..... A63C 11/221 280/823
2,542,967 A * 2/1951 Waechter ..... F16B 7/1445 248/188.5
3,572,511 A * 3/1971 Triplett ..... A47H 1/102 211/105.6
4,238,164 A * 12/1980 Mazzolla ..... B05C 17/0205 403/109.5
4,856,929 A * 8/1989 Smahlik ..... A47L 1/06 248/161
5,803,643 A * 9/1998 Patelli ..... F16B 7/1463 15/144.4
9,388,837 B1 * 7/2016 Hanley ..... A47H 1/022
2005/0247414 A1 * 11/2005 Whittemore ..... E04G 21/24 160/351
2012/0152872 A1 * 6/2012 Didehvar ..... A47H 1/022 211/105.4
2012/0285914 A1 * 11/2012 Carney ..... A47H 1/022 211/123
2014/0131299 A1 * 5/2014 Didehvar ..... A47H 1/022 211/105.2
2014/0263123 A1 * 9/2014 Ford ..... A47H 1/022 211/105.4
2016/0206126 A1 * 7/2016 Ford ..... A47H 1/022
2016/0374497 A1 * 12/2016 McCarthy ..... A47H 5/06 160/310

* cited by examiner

*Primary Examiner* — Michael Safavi

(57) ABSTRACT

A curtain rod structure has an inner tube, an outer tube and a blocking unit disposed between the inner and outer tubes. The blocking unit is configured for securing and releasing the length adjustment for the inner tube and the outer tube. By rotating one of the inner tube or the outer tube, the packing cover of the blocking unit is released from the outer tube for adjustment.

6 Claims, 6 Drawing Sheets

CURTAIN ROD

BACKGROUND OF THE INVENTION

1. Field of the Invention

The present invention relates to a flexible rod, and more particularly to a curtain rod.

2. Description of the Related Art

Currently, for a conventional curtain rod, as shown in FIG. 6, the curtain rod 40 has an inner tube 41, an outer tube 42 and a spring 43 disposed in between the inner and outer tubes 41, 42. One end of the spring 43 pushes against one end of the outer tube 41, and another end of the spring 43 extends into the inner tube 41. The inner tube 41 further has ribs 411 inside engaging with the spring 41. When the inner tube 41 is rotated, the ribs 411 move along the spring 41 to allow the curtain rod 40 to provide different lengths.

However, the prior art curtain rod has following problem: in order to change the length of the curtain rod 40, the inner tube 41 needs to be rotated along the spring 43. In order to reach to the desired length of the curtain rod 40, the inner tube 41 needs to be rotated many times, which is inconvenient and might cause damage on the inner tube 41.

Therefore, it is desirable to provide a curtain rod to mitigate and/or obviate the aforementioned problems.

SUMMARY OF INVENTION

An objective of present invention is to provide a cover structure for a washer pump which is capable of improving the above-mention problems.

In order to achieve the above mentioned objective, a curtain rod structure has an inner tube, an outer tube and a blocking unit disposed between the inner and outer tubes. An outer diameter of the inner tube is smaller than an inner diameter the outer tube, and the inner tube is removeably disposed in the outer tube. The blocking unit has a fixed sleeve, a spring, an axial rod and a packing cover. The fixed sleeve is mounted at an open end of the inner tube and has a non-circular through aperture at a bottom. An end of the spring is disposed in the fixed sleeve. The axial rod is a non-circular rod removeably disposed through the through aperture of the fixed sleeve. An end of the axial rod provided with a tapered secured end for limiting the through aperture, and another end of the axial rod provided with a blocking portion pushing against another end of the spring. A tapered assembling portion is disposed at an end of the blocking portion, a threaded section is provided around the assembling portion, and a tapered aperture has a threaded section is formed on the packing cover and configured for engaging with an assembling portion of the axial rod.

The packing cover has at least one slot and a plurality of ribs configured for holding an inner surface of the outer tube.

Other objects, advantages, and novel features of invention will become more apparent from the following detailed description when taken in conjunction with the accompanying drawings.

DETAILED DESCRIPTION OF PREFERRED EMBODIMENT

Figure 1:
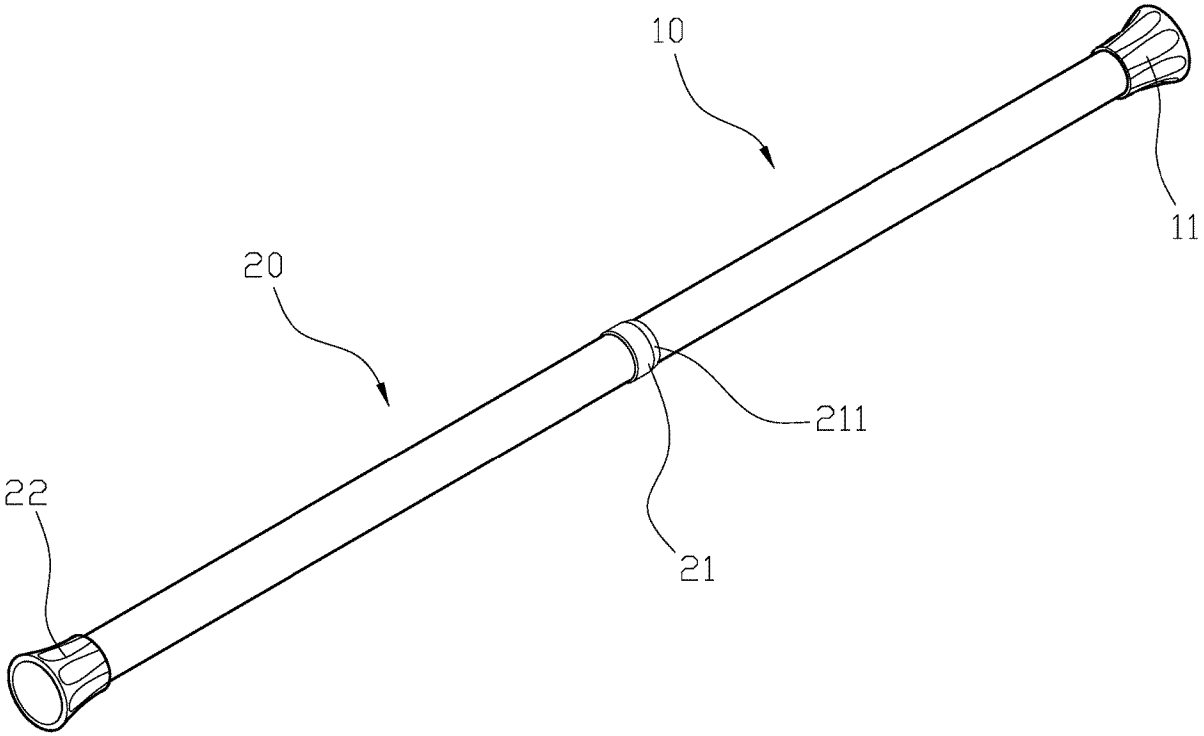
FIG. 1 is a perspective drawing of a preferred embodiment according to the present invention.
Figure 2:
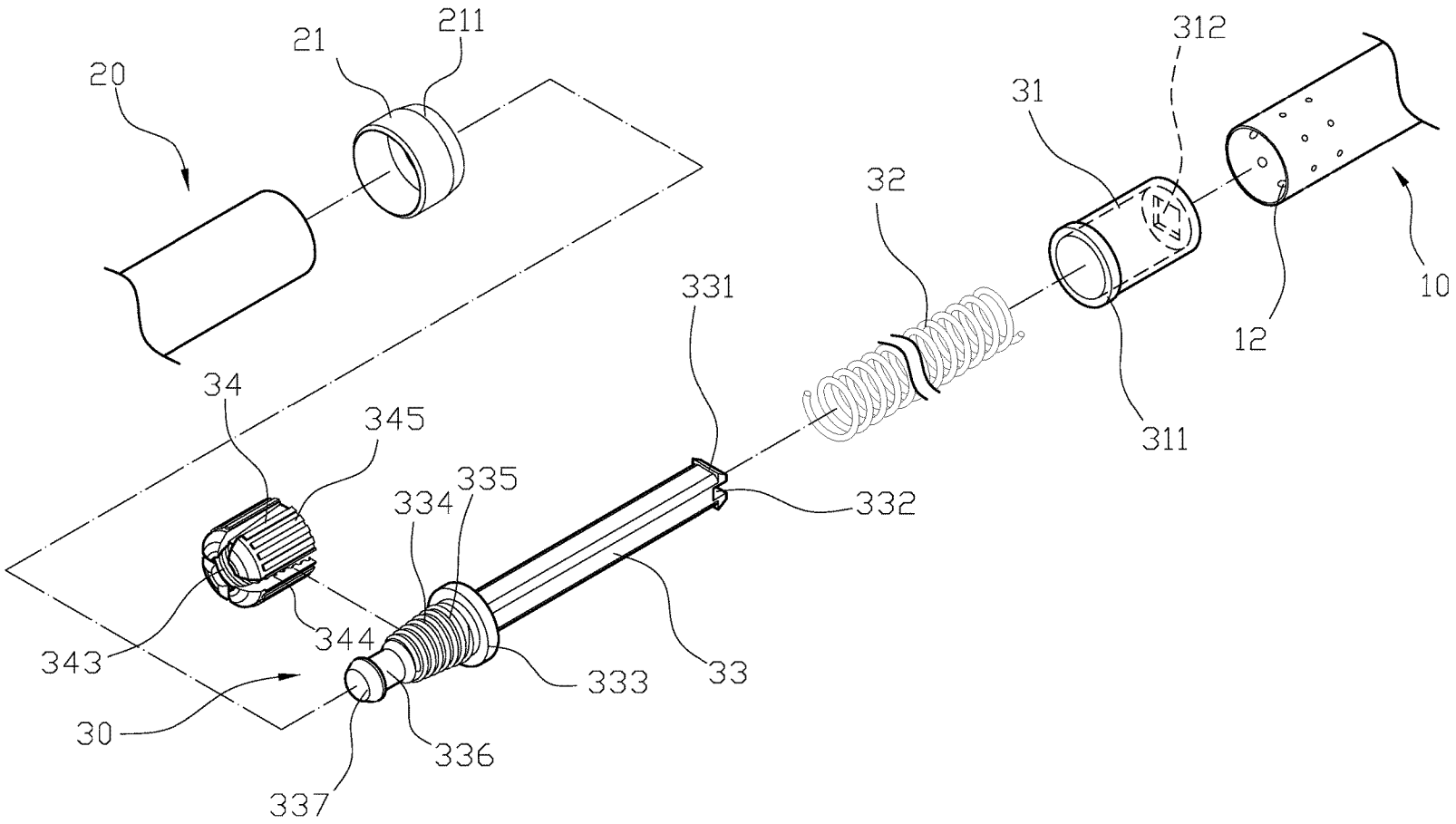
FIG. 2 is an exploded view of the preferred embodiment according to the present invention.
Figure 3:
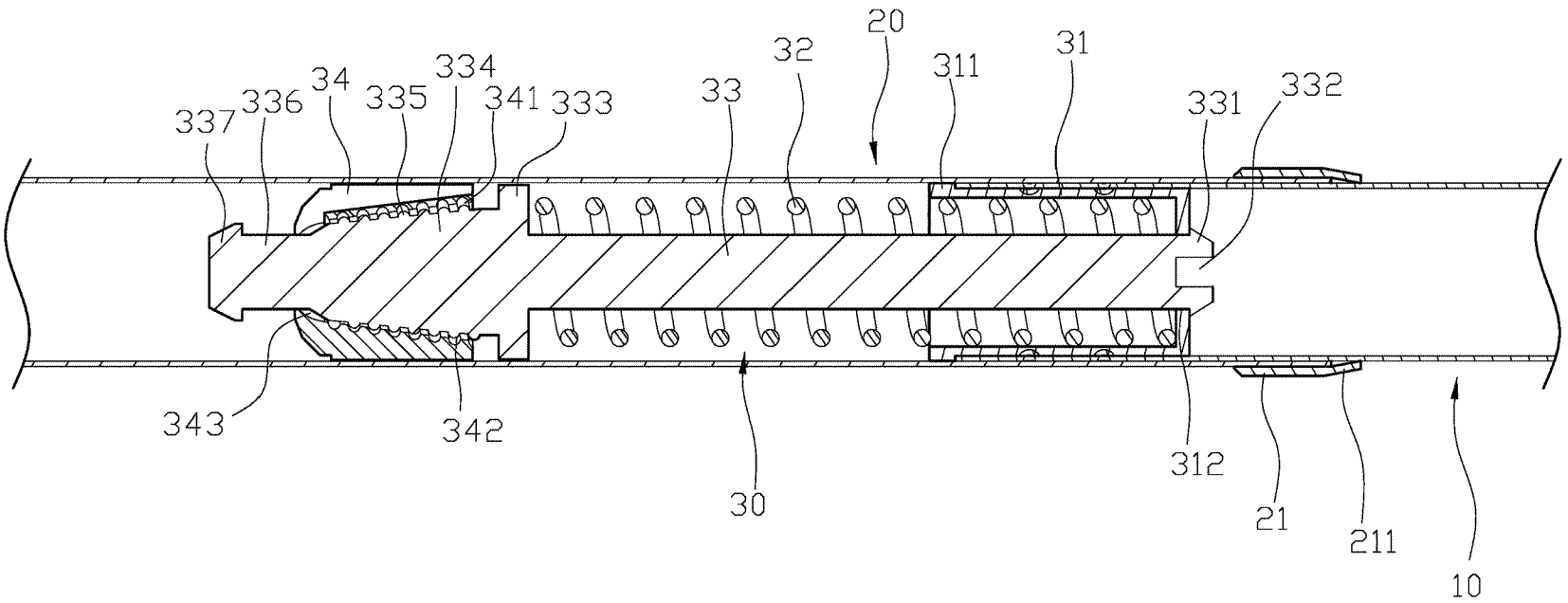
FIG. 3 is a cross-sectional drawing of the preferred embodiment according to the present invention.

First, please refer to FIG. 1, FIG. 2 and FIG. 3. An embodiment curtain rod comprises an inner tube 10, an outer tube 20 and blocking unit 30 disposed between the inner and outer tubes 10, 20. An outer diameter of the inner tube 10 is smaller than an inner diameter of the outer tube 20, and the inner tube 10 is removeably disposed in the outer tube 20. A jacket 21 is disposed on an outside of an open end of the outer tube 20, and an end of the jacket 21 is provided with a section 211 jacketed onto the inner tube 10. In addition, a cover 11, 22 is respectively provided onto the inner and outer tubes 10, 20. The blocking unit 30 has a fixed sleeve 31, a spring 32, an axial rod 33 and a packing cover 34. The fixed sleeve 31 is mounted at an open end of the inner tube 10 and has a non-circular through aperture 312 at a bottom thereof. An end of the spring 32 is disposed in the fixed sleeve 31. The axial rod 33 is a non-circular rod removeably disposed through the through aperture 312 of the fixed sleeve 31. An end of the axial rod 33 is provided with a tapered securing end 331 for limiting movement out of the through aperture 312. The securing end 331 of the axial rod 33 further comprises a slot 332 such that the securing end 331 is able to have different widths. Another end of the axial rod 33 is provided with a blocking portion 333 pushing against another end of the spring 32. A tapered assembling portion 334 is disposed at an end of the blocking portion 33, and a threaded section 3335 is provided around the assembling portion 334. Furthermore, the axial rod 33 further comprises an axial bar 336 extending from the assembling portion 334, and an end of the axial bar 336 is provided with an enlarged and tapered limiting portion 337. A tapered aperture 341 having a threaded section 342 is formed on the packing cover 34 and configured for engaging with the assembling portion 334 of the axial rod 33. The packing cover 34 further comprises a through hole 343 axially connected to the tapered aperture 341, and the through hole 343 is moveably disposed on the axial bar 336 and limited by the limiting portion 337. The packing cover 34 has at least one slot 344 and a plurality of ribs 345 configured for holding an inner surface of the outer tube 20.

For a structural assembly, please refer to FIGS. 1, 2, 3, and 4. The blocking unit 30 utilizes the fixed sleeve 31 to contain one end of the spring 32. The axial rod 33 is placed inside of the spring 32, and the securing end 331 passes through the through aperture 312 of the fixed sleeve 31 such that the spring 32 is held between the blocking portion 333 of the axial rod 33 and the fixed sleeve 31 and compressed by movement of the axial rod 33. The tapered aperture 341 of the packing cover 34 is screwed onto the assembling portion 334 of the axial rod 33, and with the through hole 343 the packing cover 34 is able to move along the axial bar 336 but is limited by the limiting portion 337. The packing cover 34 further has at least one slot 344 providing different widths for the blocking unit 30. Moreover, the fixed sleeve 31 of the blocking unit 30 is assembled onto an open end of the inner tube 10, and a plurality of round protrusions 12 are disposed in the open end of the inner tube 10. The round protrusions 12 make contact with the outer surface of the fixed sleeve 31, and the stopping ring 311 abuts at the open end of the inner tube 10. Finally, the inner tube 10 brings the blocking unit 30 into the outer tube 20, the packing cover 34 makes contact with the inner surface of the outer tube 20. When the inner tube 10 is rotated, the axial rod 33 rotates simultaneously but not the packing cover 34. When the outer tube 20 is rotated, the packing cover 34 rotates simultaneously but not the axial rod 33. Either way can make the assembling portion 334 to gradually engage with the packing cover 34; the packing cover 34 is expended by the assembling portion 334 to push against the inner surface of the outer tube 20.

Figure 4:
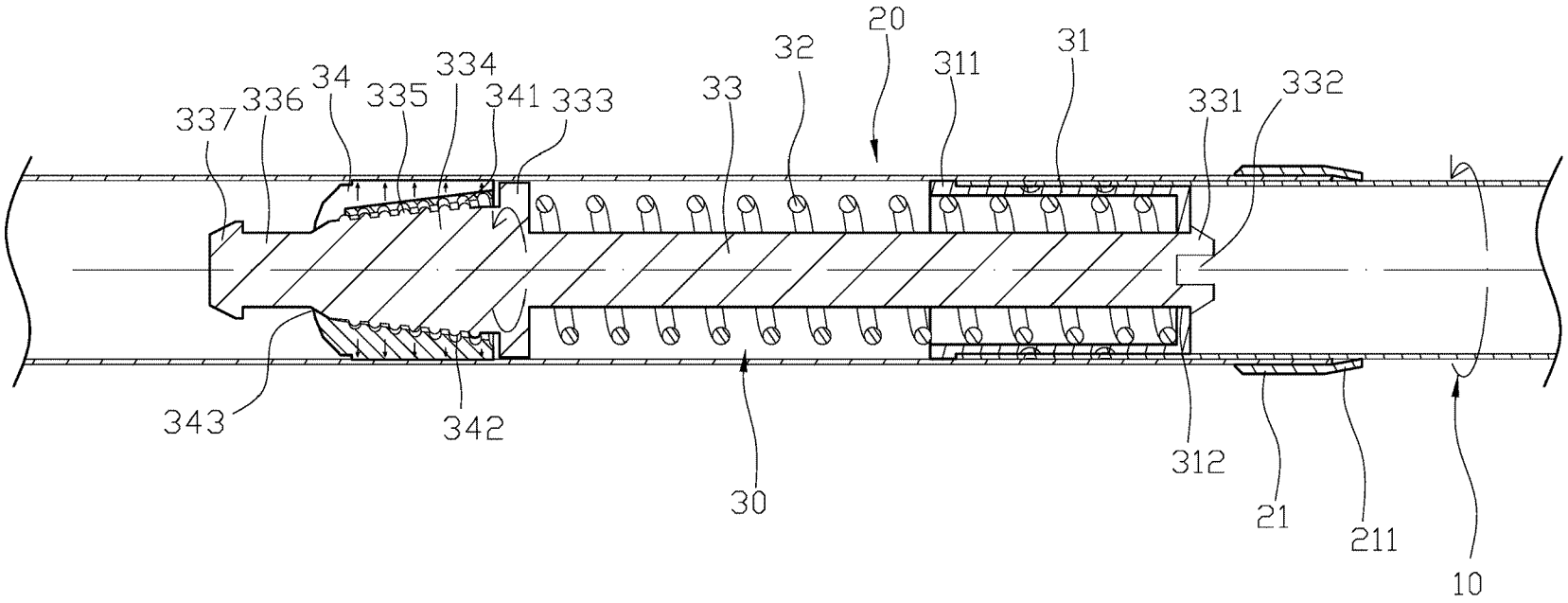
FIG. 4 is schematic drawing showing the curtain rod is tighten according to the present invention.

For actual usage, please refer to FIG. 1 and FIG. 4. The curtain rod is configured for been held between two walls by squeezing the curtain rod with a predetermined length slightly longer than a distance between the two walls. When the inner and outer tubes 10, 20 are both squeezed, the spring 32 is compressed by the blocking portion 333 of the axial rod 33 and the fixed sleeve 31. When the inner and outer tubes 10, 20, the spring 32 pushes the inner and outer tubes 10, 20 against the two walls.

Figure 5:
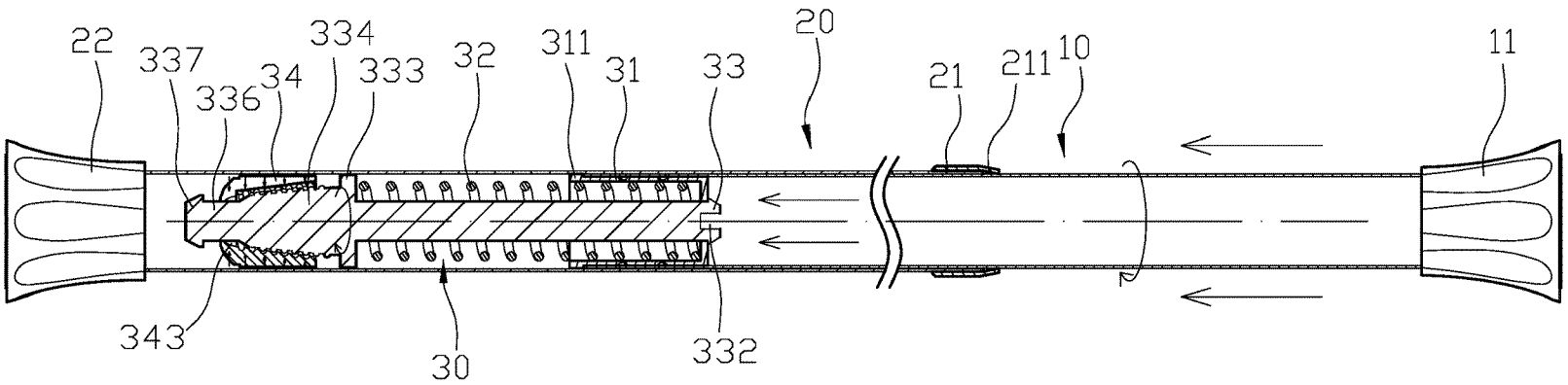
FIG. 5 is schematic drawing showing the length of the curtain rod is flexible according to the present invention.
Figure 6:
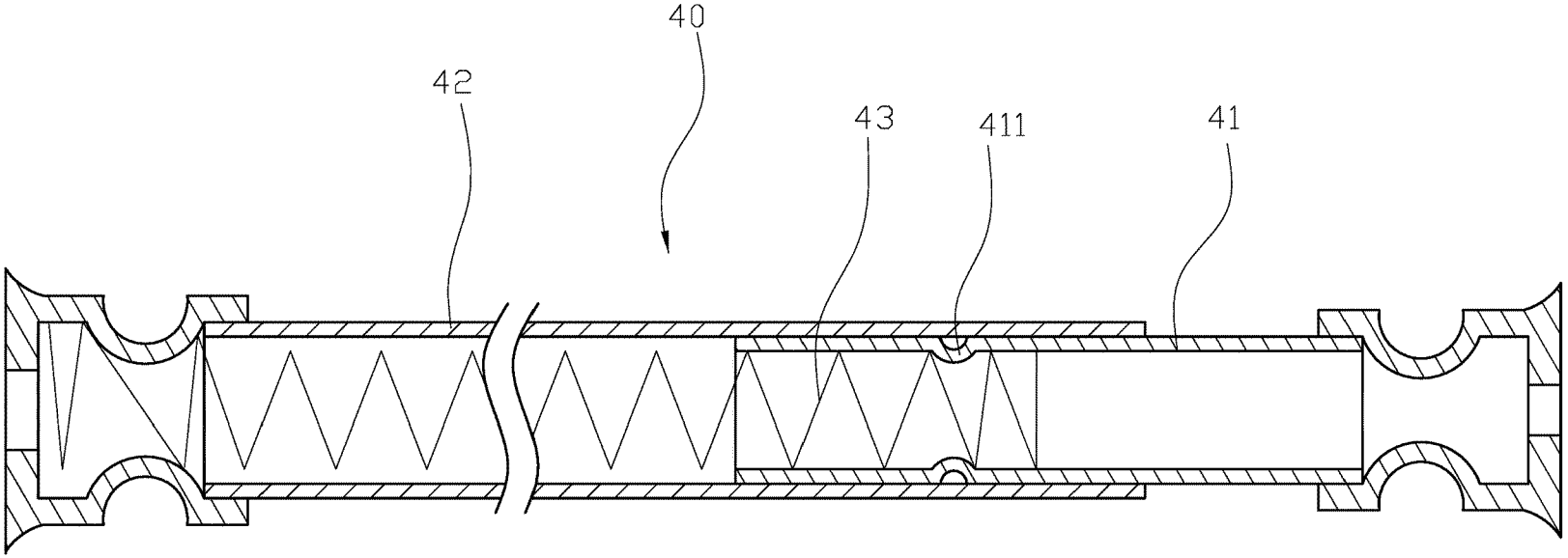
FIG. 6 PRIOR ART
FIG. 6 is schematic drawing showing a prior art curtain rod.

Moreover, for adjusting the length of the curtain rod, please refer to FIGS. 4 and 5. The packing cover 34 of the blocking unit 30 pushes against the inside of the outer tube 20 due to the assembling portion 334, by rotating the inner tube 10 or the outer tube 20 in a releasing direction the assembling portion 334 can gradually eject out from the packing cover 34 such that the packing cover 34 is able to shrink-in and disengages from the outer tube 20. Therefore, the inner and outer tubes 10, 20 can easily be pulled or pushed to adjust the length of the curtain rod. Finally, by rotating the inner and outer tubes 10, 20 reversely, the blocking unit 30 engages with the outer tube 20 to secure the length of the curtain rod.

With the above-mentioned structure, following benefits can be obtained: since the blocking unit 30 is configured for securing and releasing the length adjustment for the inner tube 10 and the outer tube 20. By rotating one of the inner tube 10 or the outer tube 20, the packing cover 34 of the blocking unit 30 is released from the outer tube 20 for adjustment.

Although the present invention has been explained in relation to its preferred embodiment, it is to be understood that many other possible modifications and variations can be made without departing from the spirit and scope of invention as hereinafter claimed.

What is claimed is:

1. A curtain rod structure comprising:

an inner tube, an outer tube, and a blocking unit disposed between the inner and outer tubes, an outer diameter of the inner tube being smaller than an inner diameter of the outer tube, and the inner tube slidably disposed in the outer tube;

wherein the blocking unit has a fixed sleeve, a spring, an axial rod and a packing cover, the fixed sleeve mounted at an open end of the inner tube and having a non-circular through aperture at a bottom end thereof, an end of the spring disposed in the fixed sleeve, the axial rod being a non-circular rod disposed through the through aperture of the fixed sleeve, an end of the axial rod provided with a tapered securing end for limiting movement out of the through aperture, another end of the axial rod provided with a blocking portion pushing against another end of the spring;

a tapered assembling portion disposed at an end of the blocking portion, a threaded section provided around the assembling portion; and a tapered aperture having a threaded section is formed in the packing cover and configured for engaging with the assembling portion of the axial rod;

wherein the packing cover has at least one slot and a plurality of ribs configured for holding an inner surface of the outer tube.

2. The curtain rod as claimed in claim 1, wherein a jacket is disposed on an outside of an open end of the outer tube, and an end of the jacket is provided with a section jacketed onto the inner tube.

3. The curtain rod as claimed in claim 1, wherein each of the inner and outer tubes comprises a cover disposed on a respective end of the inner and outer tubes.

4. The curtain rod as claimed in claim 1, wherein the open end of the inner tube further comprises a plurality of round protrusions providing friction between the inner tube and the fixed sleeve, and the fixed sleeve further comprises a stopping ring abutting an edge of the inner tube.

5. The curtain rod as claimed in claim 1, wherein the axial rod further comprises an axial bar extending from the assembling portion, an end of the axial bar provided with an enlarged and tapered limiting portion, and the packing cover further comprises a through hole axially connected to the tapered aperture, the axial bar rotatably disposed through the through hole and limited by movement out of the through hole by the limiting portion.

6. The curtain rod as claimed in claim 1, wherein the securing end of the axial rod further comprises a slot such that the securing end is able to have different widths.

* * * * *